United States Patent [19]

Töpfl

[11] Patent Number: 4,695,289

[45] Date of Patent: Sep. 22, 1987

[54] PROCESS FOR IMPROVING THE COLOUR YIELD AND WETFASTNESS PROPERTIES OF DYEINGS OR PRINTS PRODUCED ON CELLULOSIC FABRICS WITH ANIONIC DYES: TREATMENT WITH CATIONIC IMIDAZOLE

[75] Inventor: Rosemarie Töpfl, Dornach, Switzerland

[73] Assignee: Ciba-Geigy Corporation, Ardsley, N.Y.

[21] Appl. No.: 794,935

[22] Filed: Nov. 4, 1985

[30] Foreign Application Priority Data

Nov. 5, 1984 [CH] Switzerland ..... 5285/84

[51] Int. Cl.[4] ..... D06P 1/64; D06P 3/60; C07D 233/60; D06B 1/14

[52] U.S. Cl. ..... 8/573; 8/576; 8/612; 8/680; 8/918

[58] Field of Search ..... 8/573, 576, 612, 680

[56] References Cited

U.S. PATENT DOCUMENTS

| | | | |
|---|---|---|---|
| 2,043,164 | 6/1936 | Gränacher | 548/325 |
| 3,435,049 | 3/1969 | Hoffer | 548/338 |
| 4,035,145 | 7/1977 | Gipp et al. | 8/565 |
| 4,468,228 | 8/1984 | Dvorsky et al. | 8/541 |
| 4,499,282 | 2/1985 | Dvorsky et al. | 548/336 |

*Primary Examiner*—A. Lionel Clingman

*Attorney, Agent, or Firm*—Edward McC. Roberts; Meredith C. Findlay

[57] ABSTRACT

The invention relates to a process for improving the color yield and wetfastness properties of dyeings or prints produced on cellulosic materials with anionic dyes. The process comprises treating the cellulosic fabric before, during or after dyeing with a cationic fiber-reactive compound which is the reaction product of an imidazole compound containing in 2-position phenyl or an aliphatic radical of not less than 5 carbon atoms, and an epihalohydrin.

19 Claims, No Drawings

PROCESS FOR IMPROVING THE COLOUR YIELD AND WETFASTNESS PROPERTIES OF DYEINGS OR PRINTS PRODUCED ON CELLULOSIC FABRICS WITH ANIONIC DYES: TREATMENT WITH CATIONIC IMIDAZOLE

The present invention relates to a process for improving the colour yield and wetfastness properties of dyeings or prints produced on cellulosic materials with anionic dyes. The process comprises treating the cellulosic fabric before, during or after dyeing with a cationic fibre-reactive compound which is the reaction product of an imidazole compound containing in 2-position an aliphatic radical of not less than 5 carbon atoms, preferably of 7 to 23 carbon atoms, or phenyl, and an epihalohydrin.

The cationic compounds employed in the process of this invention are imidazolium compounds which, in 2-position, carry phenyl or preferably the aliphatic radical and which carry at both nitrogen atoms fibre-reactive groups formed by addition of the epihalohydrin.

The cationic compounds are preferably those of the formula

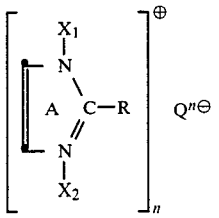

(1)

wherein

R is an aliphatic radical of not less than 5, preferably of 7 to 23, carbon atoms or is phenyl, $X_1$ and $X_2$ are each independently the

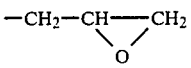

or preferably

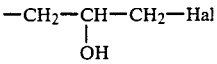

group,

Hal is a halogen atom, n is 1 or 2, $Q^{\ominus}$ is an anion of a strong inorganic or organic acid, and the imidazole ring A is unsubstituted or substituted by lower alkyl which is in turn unsubstituted or substituted by halogen, hydroxy or cyano.

In the definition of the substituents of the imidazole ring A, lower alkyl generally denotes those groups or moieties which contain from 1 to 5, preferably from 1 to 3, carbon atoms, e.g. methyl, ethyl, n-propyl, isopropyl, n-butyl, isobutyl, tert-butyl, n-amyl, isoamyl or tert-amyl.

If the imidazole ring A carries substituted lower alkyl radicals, such radicals are preferably haloalkyl, cyanoalkyl or hydroxyalkyl, each containing 2 to 4 carbon atoms, for example 2-chloroethyl, 2-cyanoethyl, 2-hydroxyethyl or 3-hydroxypropyl.

The unsubstituted or substituted alkyl radicals may be present in the 4-and/or 5-position.

Halogen as moiety of all substituents mentioned throughout this specification denotes for example bromine, fluorine or, preferably, chlorine.

The preferred substituent at the ring A is methyl. Methyl is preferably in the 4-position of the imidazole ring.

As aliphatic radical, R may be saturated or unsaturated, straight chain or branched. Conveniently, R is an alkenyl radical or preferably an alkyl radical, each of 7 to 21 carbon atoms, preferably of 9 to 17 carbon atoms. Examples of such alkyl radicals are: heptyl, octyl, isooctyl, nonyl, isononyl, undecyl, dodecyl, tridecyl, pentadecyl, heptadecyl, nonadecyl, heneicosyl or tricosyl.

The fibre-reactive groups $X_1$ and $X_2$ are preferably identical and are in particular

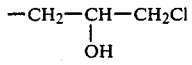

(chlorohydrin groups).

Suitable anions $Q^{\ominus}$ are anions of inorganic acids such as the chloride, bromide, fluoride, iodide, sulfate or phosphate ion, as well as of organic acids, e.g. of aromatic or aliphatic sulfonic acids such as the benzenesulfonate, p-toluenesulfonate, chlorobenzenesulfonate, methanesulfonate or ethanesulfonate ion, and also the anions of lower carboxylic acids such as the acetate, propionate or oxalate ion.

$Q^{\ominus}$ is preferably the chloride, bromide or sulfate ion.

Interesting cationic fibre-reactive compounds are those of the formula

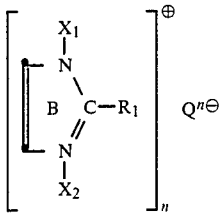

(2)

wherein $Q^{\ominus}$, n, $X_1$ and $X_2$ have the given meanings and both radicals X are preferably

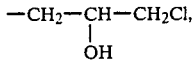

$R_1$ is $C_9$–$C_{17}$alkyl or phenyl and the ring B is unsubstituted or substituted by methyl or ethyl.

Cationic fibre-reactive compounds meriting particular interest are imidazolium compounds of the formula

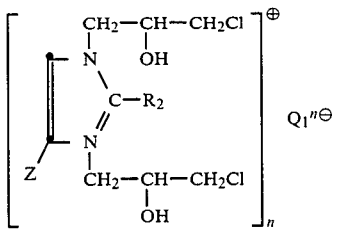

(3)

wherein $R_2$ is $C_{11}$–$C_{17}$alkyl or phenyl,

Z is hydrogen or methyl, n is 1 or 2, and $Q_1^{n\ominus}$ is the chloride or sulfate ion.

Among the imidazolium salts of formulae (2) and (3), those in which $R_1$ and $R_2$ represent the respectively defined alkyl radical are preferred.

Typical representatives of the eligible imidazolium compounds are:

1,3-bis(3'-chloro-2'-hydroxypropyl)-2-undecylimidazolium chloride 1,3-bis(3'-chloro-2'-hydroxypropyl)-2-undecylimidazolium sulfate 1,3-bis(3'-chloro-2'-hydroxypropyl)-2-heptadecylimidazolium sulfate 1,3-bis(3'-chloro-2'-hydroxypropyl)-2-undecyl-4-methylimidazolium sulfate, 1,3-bis(3'-chloro-2'-hydroxypropyl)-2-phenylimidazolium sulfate, 1,3-bis(3'-chloro-2'-hydroxypropyl)-1-2-phenyl-4-methylimidazolium sulfate The two first named representatives are particularly preferred.

The preparation of the imidazolium salts is effected in a manner which is known per se. The procedure preferably is that 1 mole of a suitable imidazole compound, or preferably an acid salt thereof with e.g. hydrochloric acid or sulfuric acid, is reacted with 2 moles of an epihalohydrin such as epibromohydrin, β-methylepichlorohydrin or, preferably, epichlorohydrin.

The reaction conditions for the preparation of the imidazolium salts shall be so chosen that a premature exchange of mobile substituents does not occur either as a result of too high pH values of the reaction mixture or as a consequence of too high a temperature. The reaction is therefore preferably carried out in dilute aqueous medium under as mild temperature and pH conditions as possible, conveniently in the temperature range from 30° to 95° C. and in the pH range from 5 to 8, preferably from 5.5 to 7. To obtain the desired pH value, a hydrohalic acid, e.g. hydrochloric acid, or sulfuric acid, may be added.

The reaction of the imidazole compound with the epihalohydrin may be carried out by heating the components to temperatures from 40° to 95° C., if desired also in an organic solvent.

Suitable organic solvents which form the reaction medium are aliphatic lower alcohols, e.g. methanol, ethanol, propanol, isopropanol; cycloaliphatic or preferably aromatic hydrocarbons such as cyclohexane, benzene, toluene or xylene; chlorinated hydrocarbons such as ethylene chloride or tetrachloroethylene; cyclic ethers, e.g. dioxane or tetrahydrofuran: dimethylsulfoxide, or nitriles of aliphatic monocarboxylic acids, e.g. acetonitrile, propionitrile or butyronitrile. Mixtures of the above solvents may also be used.

Suitable imidazole components for the preparation of the imidazolium salts are e.g.: 2-heptylimidazole, 2-undecylimidazole, 4-methyl-2-undecylimidazole, 4,5-dimethyl-2-undecylimidazole, 4-ethyl-2-undecylimidazole, 2-heptadecylimidazole, 2-phenylimidazole, 4-cyanoethyl-2-undecylimidazole, and the corresponding acid salts.

2-Heptadecylimidazole, 2-phenylimidazole and, in particular, 2-undecylimidazole, are most preferred.

The treatment of the cellulosic fabric with the cationic imidazole compound is preferably effected continuously by a pad process in which the cellulosic fabric is impregnated with the fixing agent, e.g. by padding, and then subjected to a fixation process. This application may be made before during or after dyeing. It is preferred to carry out the treatment after or, most preferably, during dyeing. The aftertreatment may be applied to dyeings as well as to colour prints.

The impregnating step may be carried out in the temperature range from 20° to 70° C., but preferably at room temperature. The fixation step can be carried out by a steam process, a thermosol process, a microwave treatment or by a hot dwell or cold pad batch process.

In the steaming process, the textile fabrics padded with the treatment liquor are subjected to a fixation treatment in a steamer with steam or superheated steam, advantageously in the temperature range from 98° to 130° C., preferably from 102° to 110° C.

The thermosol fixation can be effected after or without intermediate drying, e.g. in the temperature range from 100° to 210° C. The thermosol fixation is preferably carried out in the temperature range from 120° C. to 210° C., most preferably from 140° to 180° C., and after first drying the padded or printed goods at 80° to 120° C. Depending on the temperature, the thermosol fixation may take from 20 seconds to 5 minutes, preferably from 30 to 180 seconds.

The thermofixation may also be effected with microwaves. In this method, the goods are conveniently rolled up and treated in a chamber with microwaves after they have been impregnated with the treatment liquor and pinched-off to remove excess liquor. This microwave treatment may take from 2 to 120 minutes, but 2 to 15 minutes preferably suffice. By microwaves are meant electromagnetic waves (radio waves) in the frequency range from 300 to 100,000 mHz, preferably 1000 to 30,000 mHz.

In the hot dwell process, the padded or printed goods are left in the moist state for e.g. 15 to 120 minutes, advantageously in the temperature range from 85° to 102° C. In this case, the impregnated goods can be preheated to 85°–120° C. by an infra-red treatment. The dwell temperature is preferably from 90° to 100° C.

The fixation stage can also be effected by the cold pad batch process, in which the padded or printed goods, which are preferably rolled up, are stored at room temperature (15°–30° C.) for e.g. 3 to 24 hours. If desired, the goods may also be stored at slightly elevated temperature (30°–80° C.).

Treatment with the imidazolium salts is preferably carried out by the cold pad batch process and, in particular, during dyeing.

The treatment after dyeing is preferably carried out by padding the dyed or printed fabric followed by the subsequent thermosol fixation.

The treatment of the textile fabrics with the imidazolium salts can also be carried out by the exhaust process before or after dyeing, but preferably during dyeing. In this case, treatment may be effected in the temperature range from 20° to 135° C., preferably from 40° to 100° C. The liquor to goods ratio may be chosen within a wide range, for example from 1:2.5 to 1:100, preferably from 1:5 to 1:40.

In the exhaust process, the treatment liquors preferably contain the imidazolium salts in an amount of 1 to 25% by weight, most prefer-ably from 2 to 15% by weight, based on the weight of the cellulosic fabric, whereas padding liquors or printing pastes preferably contain them in an amount of 1 to 100 g/l, most preferably 10 to 50 g/l with the goods being conveniently pinched-off to a pick-up of 60 to 120% by weight in the pad process.

The dyes employed are the substantive dyes or reactive dyes conventionally used for dyeing cellulosic fabrics. Suitable substantive dyes are the customary direct dyes, for example the "Direct Dyes" listed in the Colour Index, 3rd edition (1971), Vol. 2, pp. 2005–2478.

By reactive dyes are meant the customary dyes which form a chemical bond with cellulose, for example the "Reactive Dyes" listed in the Colour Index, Vol. 3 (3rd edition, 1971) on pages 3391–3560 and in Vol. 6 (revised 3rd edition, 1975) on pages 6268–6345.

When dyeing and carrying out the treatment with the imidazolium salts simultaneously, the amount of dye will normally depend on the desired tinctorial strength and in the continuous process is conveniently from 0.1 to 100 g per liter of liquor, preferably from 5 to 60 g per liter of liquor. In the exhaust process, the amount of dye is advantageously from 0.1 to 10% by weight, preferably from 1 to 6% by weight.

Besides the cationic imidazolium salts, the liquors employed in the process of this invention additionally contain alkalies such as sodium carbonate, sodium bicarbonate, sodium hydroxide, disodium phosphate, trisodium phosphate, borax, aqueous ammonia or alkali donors such as sodium trichloroacetate or sodium formate.

The pH of the treatment and dye liquors is accordingly usually in the range from 8 to 13.5, preferably from 8.5 to 13.

If desired, the liquors may also contain urea, glycerol, sodium formate, electrolytes such as sodium chloride or sodium sulfate, alkali-resistant wetting agents, homopolymers or copolymers of acrylamide or methacrylamide, or the graft polymers described in European published patent application EP-A-111454, as well as thickeners, e.g. alginates, starch ethers or carob seed gum ether.

The process of this invention is suitable for the treatment of textiles which consist of cellulose or which contain cellulose.

Suitable cellulosic fabric is that made from regenerated or, in particular, natural cellulose, for example viscose rayon, viscose silk, cellulose acetate, hemp, jute or, preferably, cotton, as well as blends, e.g. polyamide/cotton or, in particular, polyester cotton blends, in which the polyester component may be predyed or cross-dyed.

The textile fabric may be in any form, for example yarn, hanks, woven fabrics, knitted fabrics, felt, but is preferably in the form of textile planar structures such as woven or knitted goods which consist wholly or partly of native, regenerated or modified cellulose.

The process of this invention gives level and strong dyeings which, compared with those obtained with known processss, are distinguished by improved colour yield. In particular, dyeings and prints with substantially improved wetfastness properties are obtained on cellulosic fabric with reactive dyes as well as with substantive dyes. In addition, the use of the imidazolium salts of this invention does not impair the decrease in tear resistance of the dyeings.

In the following Preparatory and Use Examples, percentages are by weight unless otherwise indicated. The amounts of dye refer to commercial, i.e. diluted, product, and amounts of auxiliaries refer to pure substance. The 5-digit Colour Index (C.I.) numbers refer to the 3rd. edition of the Colour Index.

PREPARATORY EXAMPLES

Example A 41.6 g of 2-undecylimidazole are dissolved in 166.4 g of water and 5.1 g of 96% sulfuric acid. The solution is warmed to 60° C. and 37 g of epichlorohydrin are added dropwise over 30 minutes, the temperature rising to 74° C. When the dropwise addition is complete, the reaction mixture is stirred for 4 hours at 90° C., after which time the amine number and epoxy number are each 0. The resultant solution is evaporated to dryness, affording 83 g of 1,3-bis(3'-chloro-2'-hydroxypropyl)-2-undecylimidazolium sulfate.

Example B 76.5 g of 2-heptadecylimidazole are dissolved in 280 g of water and 6.4 g of 96% sulfuric acid by heating to 60° C. Then 46.25 g of epichlorohydrin are added dropwise over 30 minutes. The temperature is then raised to 90° C. and the reaction mixture is stirred for 2 hours at this temperature. Amino number and epoxy number are each 0.

The highly viscous reaction product is diluted with 204 g of water and 68 g of isopropanol, affording 681 g of a low viscosity clear solution which contains 128.8 g of 1,3-bis(3'-chloro-2'-hydroxypropyl)-2-heptadecylimidazolium sulfate. The pH of the solution is 7.8.

Example C 57.6 g of 2-phenylimidazole are dissolved in 297 g of water and 10.2 g of 96% sulfuric acid by heating to 60° C. Then 74 g of epichlorohydrin are added to this solution over 45 minutes. The temperature is subsequently raised to 90° C. and the reaction mixture is stirred for 4½ hours at this temperature. The amine number and epoxy number are each 0.

The resultant solution is concentrated to a solids content of 65%, affording 217 g of a solution which contains 141 g of 1,3-bis(3'-chloro-2'-hydroxypropyl)-2-phenylimidazolium sulfate. The pH of the solution is 7.7.

Example D 3.2 g (0.4 mole) of 2-phenyl-4-methylimidazole are dissolved in 310 g of water and 10.2 g of 96% sulfuric acid by heating to 60° C. Then 74 g of epichlorohydrin are added dropwise over 45 minutes. The temperature is subsequently raised to 90° C. and the reaction mixture is stirred at this temperature for 4½ hours. The amine number and epoxy number are each 0.

The reaction product is concentrated to a solids content of 65%, affording 226 g of a solution which contains 147 g of 1,3-bis(3'-chloro-2'-hydroxypropyl)-2-phenyl-4-methylimidazolium sulfate. The pH of the solution is 7.9.

USE EXAMPLES

Example 1

500 g of cotton yarn are wetted in 5 liters of water in a cheese dyeing machine and the liquor is then heated to 95°–98° C. Then 20 g of a dye of the formula (11)

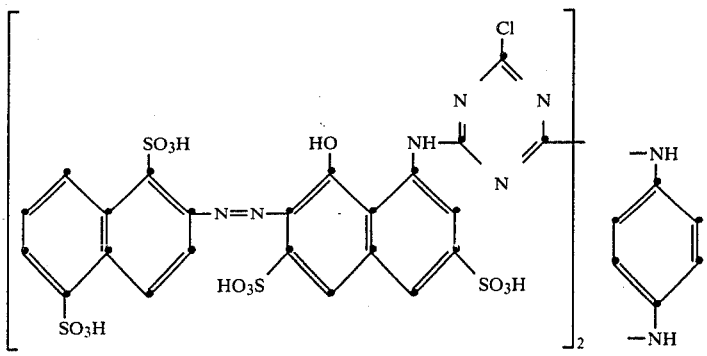

and 400 g of sodium sulfate are added. After cooling to 80° C., 10 ml of an aqueous 30% sodium hydroxide solution and 25 g of sodium carbonate are added. The dye bath is further cooled to 40° C. and 60 ml of 30% aqueous sodium hydroxide solution and 50 g of the 1,3-bis(3'-chloro-2'-hydroxypropyl)-2-undecylimidazolium sulfate prepared according to Example A are added. The cotton fabric is treated for a further 60 minutes at 40° C. and then rinsed and dried. A level, strong red dyeing of increased colour yield and with excellent wetfastness properties is obtained. The ISO C2S wash is appreciably improved.

Example 2

100 g of cotton fabric are wetted in 800 g of water in a short liquor jet dyeing apparatus. The bath is then warmed to 40° C. and 3 g of a direct dye of the formula (12)

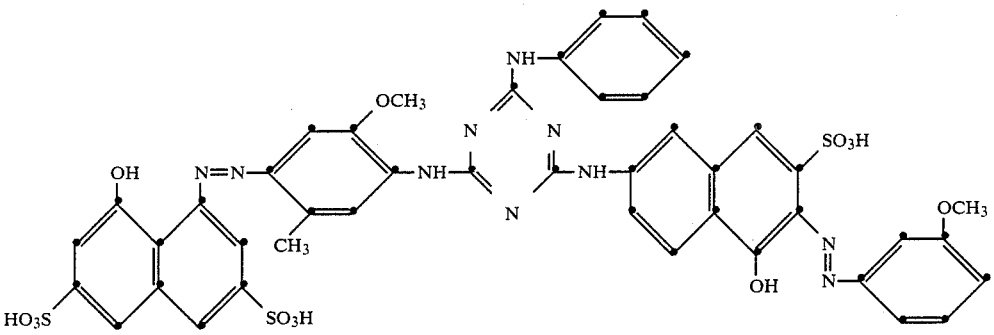

and 48 g of sodium sulfate are added. After 10 minutes, 9.6 g of an aqueous 30% sodium hydroxide solution and 8 g of the 1,3-bis(3'-chloro-2'-hydroxypropyl)-2-undecylimidazolium sulfate prepared according to Example A are added at the same temperature. The cotton fabric is then treated for 60 minutes at 40° C. and then rinsed and dried.

A level, strong red dyeing with a 50% increase in yield is obtained. The ISO C2S wash has a rating of 4.

Example 3

A cotton fabric is impregnated on a pad with a liquor which contains 60 g/l of the dye of the formula (13)

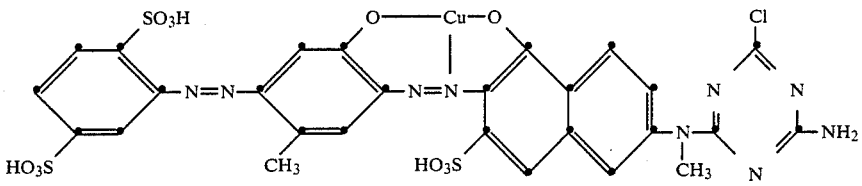

100 g/l of urea 35 g/l of 1,3-bis(3'-chloro-2'-hydroxypropyl)-2-undecylimidazolium sulfate prepared according to Example A 40 g/l of 30% sodium hydroxide solution and 3 g/l of the sodium salt of 3-nitrobenzenesulfonic acid.

The liquor pick-up is 80%. The fabric is then rolled up and stored for 18 hours at room temperature, then washed hot and cold and dried.

The strong, level blue dyeing so obtained exhibits a 20% improvement in colour yield. After storage for 3 days at 60° C. in a saturated steam atmosphere, the dyeing causes no staining of the adjacent fabric (hydrolysis test before the ISO C2S wash). The ISO C2S wash also has the rating 4 after the hydrolysis test.

Example 4

Cotton tricot is padded with a liquor which contains 12 g/l of the dye of the formula

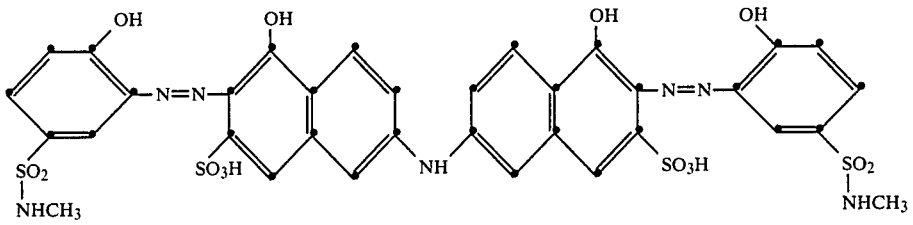

(14)

100 g/l of urea
35 g/l of 30% sodium hydroxide solution
26 g/l of 1,3-bix(3'-chloro-2'-hydroxypropyl)-2-undecylimidazolium sulfate prepared according to Example A The cotton fabric is then rolled up, packed airtight and stored for 20 hours at room temperature. The goods are afterwards rinsed and dried. The increase in yield of the strong violet dyeing so obtained is 100% and, in addition, the wetfastness properties of the dyeing are excellent. There is virtually no staining of the adjacent fabric in the ISO C2S wash test and in the test for fastness to wet pressing.

Example 5

A dyeing which has been produced on cotton tricot with 6% of the dye of formula (11) is padded to a pick-up of 85% with a liquor which contains
26 g/l of 1,3-bis(3'-chloro-2'-hydroxypropyl)-2-undecylimidazolium sulfate prepared according to Example A and
32 ml/l of 30% sodium hydroxide solution.

The goods are afterwards dried at 90° C. and then treated for 3 minutes at 140° C. The cotton fabric is subsequently rinsed and dried.

After a hydrolysis test, the fabric has the rating 4 in the ISO C2S wash test.

Example 6

A dyeing which has been obtained in conventional manner with 5% of the dye of the formula

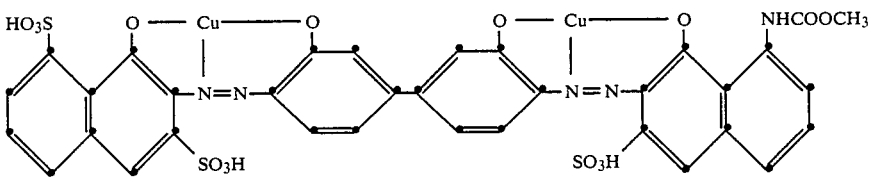

(15)

is given an aftertreatment as described in Example 5. Compared with a dyeing which has been aftertreated in conventional manner, there is no staining of the adjacent fabric in the tests for the ISO C2S wash and for fastness to wet pressing.

Example 7

A cotton fabric is padded, before dyeing, with a liquor which contains
26 g/l of 1,3-bis(3'-chloro-2'-hydroxypropyl)-2-undecylimidazolium sulfate prepared according to Example A and
32 ml/l of 30% sodium hydroxide solution.

The goods are then dried at 90° C. and subjected to a thermosol fixation at 140° C.

1 kg of the pretreated fabric is wetted in 30 liters of water at 25° C. and then 30 g of a dye of the formula

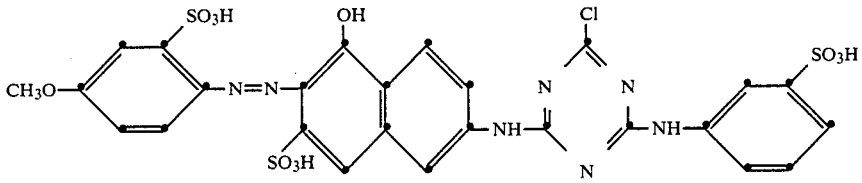

(16)

600 g of sodium carbonate and 90 ml of 30% sodium hydroxide solution are added.

The dye liquor is heated to 80° C. over 40 minutes and kept at this temperature for 60 minutes. The dyed fabric is subsequently rinsed hot and cold and dried.

The pretreatment of the fabric with the imidazolium salt improves the dye yield by 60%. In addition, the dyeing has excellent wetfastness properties.

Example 8

Bleached cotton terry is printed on a cylinder printing machine with 1 kg of a printing paste composed of
400 g of 5% alginate thickener
100 g of urea
50 g of a dye of the formula (17)

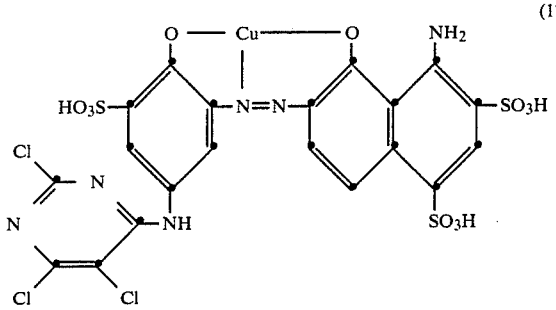

10 g of sodium m-nitrobenzenesulfonate
60 g of 30% sodium carbonate solution and
380 g of water such that 3 cm printed stripes alternate with 3 cm unprinted stripes. The printed fabric is then dried, steamed for 8 minutes at 101° C., rinsed, soaped at the boil and dried. The printed fabric is then padded to a pick-up of 85% with a liquor which contains 23 g/l of 1,3-bis(3'-chloro-2'-hydroxypropyl)-2-undecylimidazolium sulfate prepared according to Example A and 30 ml/l of 30% sodium hydroxide solution.

The fabric is then dried at 80° C. and treated for 3 minutes at 140° C., and subsequently rinsed and dried. The wetfastness properties, especially the ISO C2S wash and the fastness to wet pressing, are appreciably improved by this aftertreatment with the imidazolium salt, and also after a hydrolysis test.

Strong and level dyeings and prints with improved colour yield and excellent wetfastness properties are likewise obtained by using in Examples 1 to 8 the same amount of an imidazolium salt prepared according to Examples B, C or D instead of 1,3-bis(3'-chloro-2'-hydroxypropyl)-2-undecylimidazolium sulfate prepared according to Example A.

What is claimed is:

1. A process for improving the colour yield and wetfastness properties of dyeings or prints produced on cellulosic materials with anionic dyes, which process comprises treating the cellulosic materials before, during or after dyeing with a cationic fiber-reactive compound which is the reaction product of an imidazole compound containing in 2-position an aliphatic radical of not less than 7 carbon atoms or phenyl, and an epihalohydrin.

2. A process according to claim 1, wherein the cationic fiber-reactive compound is obtained from an imidazole compound which carries in 2-position an aliphatic radical of 7 to 23 carbon atoms.

3. A process for treating cellulosic materials which comprises comtacting said material with cationic compound is an imidazolium salt of the formula (1)

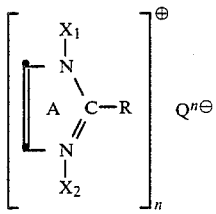

wherein

R is an aliphatic radical of not less than 7 carbon atoms or is phenyl, $X_1$ and $X_2$ are each independently the

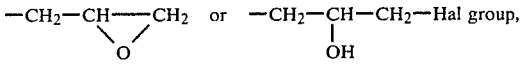

Hal is a halogen atom, n is 1 or 2, $Q^{\ominus}$ is an anion of a strong inorganic or organic acid, and the imidazole ring A is unsubstituted or substituted by lower alkyl which is in turn unsubstituted or substituted by halogen, hydroxy or cyano.

4. A process according to claim 3, wherein R in formula (1) is an alkyl radical of 7 to 21 carbon atoms.

5. A process sccording to claim 3, wherein $X_1$ and $X_2$ in formula (1) are identical.

6. A process according to claim 3, wherein $X_1$ and $X_2$ in formula (1) are the chlorohydrin group

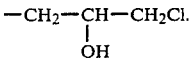

7. A process according to claim 3, wherein the cationic compound is an imidazolium salt of the formula (2)

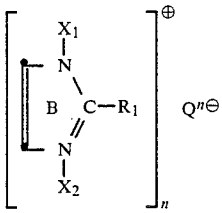

wherein $R_1$ is $C_9$–$C_{17}$alkyl or phenyl and the ring B is unsubstituted or substituted by methyl or ethyl.

8. A process according to claim 7, wherein $X_1$ and $X_2$ in formula (2) are the chlorohydrin group

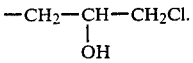

9. A process according to claim 3, wherein the cationic compound is an imidazolium salt of the formula (3)

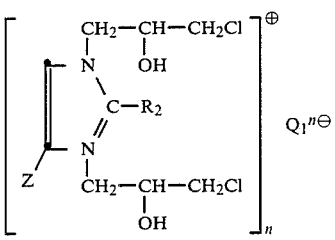

wherein $R_2$ is $C_{11}$–$C_{17}$alkyl or phenyl,

Z is hydrogen or methyl, n is 1 or 2, and $Q_1^{n\ominus}$ is the chloride or sulfate ion.

10. A process according to claim 1, wherein the cationic compound is 1,3-bis(3'-chloro-2'-hydroxypropyl)-

2-undecylimidazolium chloride or 1,3-bis(3'-chloro-2'-hydroxypropyl)-2-undecylimidazolium sulfate.

11. A process according to claim 1, wherein the treatment of the celllosic materials with the imidazolium salt is effected continuously by a pad process.

12. A process according to claim 11, wherein the treatment is effected after or during dyeing.

13. A process according to claim 11, wherein the treatment is effected by the cold pad batch process.

14. A process according to claim 1, which comprises simultaneously treating the cellulosic materials and dyeing by the cold pad batch process.

15. A process according to claim 1, which comprises carrying out the treatment of the cellulosic materials after dyeing by padding the dyed or printed materials and subsequently subjecting said materials to a thermosol fixation.

16. A process according to claim 1, wherein the treatment of the cellulosic materials with the imidazolium salt is carried out by the exhaust process.

17. A process according to claim 1, wherein the treatment of the cellulosic materials with the imidazolium salt is carried out from alkaline medium.

18. A process for improving the color yield and wetfastness properties of dyeings produced on cellulosic materials with anionic dyes, which process comprises:

(a) dyeing the cellulosic material with the anionic dye; and (b) contacting in a cold pad batch process the cellulosic material of step (a) during or after dyeing with a cationic fiber-reactive compound of the formula

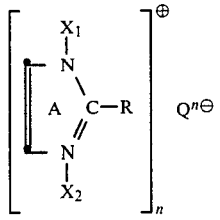

wherein

R is an alphatic radical of not less than 7 carbon atoms or is phenyl, $X_1$ and $X_2$ are each independently the

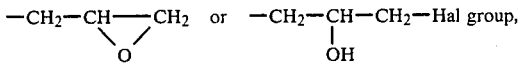

Hal is a halogen atom, n is 1 or 2,

Q⊖ is an anion of a strong inorganic or organic acid, and the imidazole ring A is unsubstituted or substituted by lower alkyl whch is in turn unsubstituted or substituted by halogen, hydroxy or cyano.

19. A process according to claim 18 wherein R in said cationic compound contains 7 to 23 carbon atoms.

* * * * *